US006966499B2

(12) United States Patent
Nally et al.

(10) Patent No.: US 6,966,499 B2
(45) Date of Patent: Nov. 22, 2005

(54) SPRAY PATTERN CONTROL WITH NON-ANGLED ORIFICES FORMED ON A GENERALLY PLANAR METERING DISC AND REORIENTED ON SUBSEQUENTLY DIMPLED FUEL INJECTION METERING DISC

(75) Inventors: John F. Nally, Williamsburg, VA (US); William A. Peterson, Jr., Smithfield, VA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 48 days.

(21) Appl. No.: 10/753,481

(22) Filed: Jan. 9, 2004

(65) Prior Publication Data

US 2004/0217208 A1 Nov. 4, 2004

Related U.S. Application Data

(60) Provisional application No. 60/439,059, filed on Jan. 9, 2003, provisional application No. 60/438,952, filed on Jan. 9, 2003, and provisional application No. 60/439,094, filed on Jan. 9, 2003.

(51) Int. Cl.[7] ..... F02D 1/06

(52) U.S. Cl. ..... 239/5; 239/533.12; 239/533.2; 239/585.1; 239/596; 239/598; 239/900

(58) Field of Search ..... 239/596, 533.12, 239/598, 601, 533.2, 585.1, 585.4, 585.5, 900, 533.14; 251/129.21, 129.19, 129.17

(56) References Cited

U.S. PATENT DOCUMENTS

| | | | |
|---|---|---|---|
| 335,334 A | 2/1886 | Brady | |
| 600,687 A | 3/1898 | Flemming | |
| 2,737,831 A | 3/1956 | Webb | |
| 2,846,902 A | 8/1958 | Cowley | |
| 4,057,190 A | 11/1977 | Kiwior et al. | |

(Continued)

FOREIGN PATENT DOCUMENTS

| | | | |
|---|---|---|---|
| DE | 19523165 | 1/1996 | ..... F02M/61/18 |
| EP | 1 092 865 A | 4/2001 | |
| EP | 1 154 151 | 11/2001 | |
| EP | 1154151 | 11/2001 | ..... F02M/61/18 |
| JP | 52-32192 | 3/1977 | |
| JP | 59-223121 | 12/1984 | |
| JP | 60-137529 | 7/1985 | |
| JP | 10-122096 | 12/1998 | |
| JP | 2000-097129 | 9/2000 | |
| WO | WO 00/52328 | 9/2000 | |

OTHER PUBLICATIONS

PCT International Search Report (PCT/US 2004/000593) Mailed Jul. 2, 2004.

*Primary Examiner*—Dinh Q. Nguyen

(57) ABSTRACT

A fuel injector that includes a housing, a seat, a metering disc and a closure member. The metering orifices can be located on a first virtual circle greater than a second virtual circle as defined by a projection of a sealing surface converging at a virtual apex projected on the metering disc. The metering disc can be dimpled to increase the spray angle. Various parameters can be utilized to achieve a desired cone size and spray angle. A method of controlling spray targeting of a fuel injector is also described.

20 Claims, 4 Drawing Sheets

U.S. PATENT DOCUMENTS 4,072,039 A 2/1978 Nakanishi
4,101,074 A 7/1978 Kiwior
4,532,906 A 8/1985 Höppel
4,621,772 A * 11/1986 Blythe et al. ..... 239/585.4
4,923,169 A 5/1990 Grieb et al.
4,925,111 A 5/1990 Foertsch et al.
4,970,926 A 11/1990 Ghajar et al.
5,002,231 A 3/1991 Reiter et al.
5,038,738 A 8/1991 Hafner et al.
5,201,806 A 4/1993 Wood
5,244,154 A 9/1993 Bucholz et al.
5,335,864 A 8/1994 Romann et al.
5,344,081 A 9/1994 Wakeman
5,365,819 A 11/1994 Maida et al.
5,449,114 A 9/1995 Wells et al.
5,484,108 A * 1/1996 Nally ..... 239/553.3
5,489,065 A 2/1996 Nally, Jr.
5,516,047 A 5/1996 Kubach et al.
5,553,397 A 9/1996 Schwitzky et al.
5,636,796 A 6/1997 Oguma
5,697,154 A 12/1997 Ogihara
5,707,012 A 1/1998 Dennerlein et al.
5,730,368 A 3/1998 Flik et al.
5,746,376 A 5/1998 Romann et al.
5,766,441 A 6/1998 Arndt et al.
5,772,124 A 6/1998 Tamaki et al.
5,785,254 A 7/1998 Zimmermann et al.
5,816,093 A 10/1998 Takeuchi et al.
5,862,991 A 1/1999 Willke et al.
5,931,391 A 8/1999 Tani et al.
6,009,787 A 1/2000 Hänggi
6,039,271 A 3/2000 Reiter
6,070,812 A 6/2000 Tani et al.
6,089,476 A 7/2000 Sugimoto et al.
6,102,299 A 8/2000 Pace et al.
6,131,826 A 10/2000 Teiwes
6,170,763 B1 1/2001 Fuchs et al.
6,394,367 B2 5/2002 Munezane et al.
6,405,946 B1 6/2002 Harata et al.
6,616,071 B2 * 9/2003 Kitamura et al. ..... 239/533.12
6,742,727 B1 * 6/2004 Peterson, Jr. ..... 239/533.3
2002/0063175 A1 5/2002 Kitamura et al.

* cited by examiner

SPRAY PATTERN CONTROL WITH NON-ANGLED ORIFICES FORMED ON A GENERALLY PLANAR METERING DISC AND REORIENTED ON SUBSEQUENTLY DIMPLED FUEL INJECTION METERING DISC

PRIORITY

This application claims the benefits of the following United States provisional patent applications:

Ser. No. 60/439,059 filed on Jan. 9, 2003, entitled "Spray Pattern Control With Non-Angled Orifices Formed On A Generally Planar Metering Disc And Reoriented On Subsequently Dimpled Fuel Injection Metering Disc";

Ser. No. 60/438,952, filed on Jan. 9, 2003 entitled "Spray Pattern Control With Non-Angled Orifices Formed On A Dimpled Fuel Injection Metering Disc Having A Sac Volume Reducer";

Ser. No. 60/439,094 filed on Jan. 9, 2003, entitled, "Spray Pattern Control With Non-Angled Orifices Formed On Dimpled Fuel Injection Metering Disc Having A Sac Volume Reducer," which provisional patent applications are herein incorporated by reference in their entirety in this application.

BACKGROUND OF THE INVENTION

Most modern automotive fuel systems utilize fuel injectors to provide precise metering of fuel for introduction into each combustion chamber. Additionally, the fuel injector atomizes the fuel during injection, breaking the fuel into a large number of very small particles, increasing the surface area of the fuel being injected, and allowing the oxidizer, typically ambient air, to more thoroughly mix with the fuel prior to combustion. The metering and atomization of the fuel reduces combustion emissions and increases the fuel efficiency of the engine. Thus, as a general rule, the greater the precision in metering and targeting of the fuel and the greater the atomization of the fuel, the lower the emissions with greater fuel efficiency.

An electro-magnetic fuel injector typically utilizes a solenoid assembly to supply an actuating force to a fuel metering assembly. Typically, the fuel metering assembly is a plunger-style needle valve which reciprocates between a closed position, where the needle is seated in a seat to prevent fuel from escaping through a metering orifice into the combustion chamber, and an open position, where the needle is lifted from the seat, allowing fuel to discharge through the metering orifice for introduction into the combustion chamber.

The fuel injector is typically mounted upstream of the intake valve in the intake manifold or proximate a cylinder head. As the intake valve opens on an intake port of the cylinder, fuel is sprayed towards the intake port. In one situation, it may be desirable to target the fuel spray at the intake valve head or stem while in another situation, it may be desirable to target the fuel spray at the intake port instead of at the intake valve. In both situations, the targeting of the fuel spray can be affected by the spray or cone pattern. Where the cone pattern has a large divergent cone shape, the fuel sprayed may impact on a surface of the intake port rather than towards its intended target. Conversely, where the cone pattern has a narrow divergence, the fuel may not atomize and may even recombine into a liquid stream. In either case, incomplete combustion may result, leading to an increase in undesirable exhaust emissions.

Complicating the requirements for targeting and spray pattern is cylinder head configuration, intake geometry and intake port specific to each engine's design. As a result, a fuel injector designed for a specified cone pattern and targeting of the fuel spray may work extremely well in one type of engine configuration but may present emissions and driveability issues upon installation in a different type of engine configuration. Additionally, as more and more vehicles are produced using various configurations of engines (for example: inline-4, inline-6, V-6, V-8, V-12, W-8 etc.), emission standards have become stricter, leading to tighter metering, spray targeting and spray or cone pattern requirements of the fuel injector for each engine configuration.

It would be beneficial to develop a fuel injector in which increased atomization and precise targeting can be changed so as to meet a particular fuel targeting and cone pattern from one type of engine configuration to another type.

It would also be beneficial to develop a fuel injector in which non-angled metering orifices can be used in controlling atomization, spray targeting and spray distribution of fuel.

SUMMARY OF THE INVENTION

The present invention provides fuel targeting and fuel spray distribution with non-angled metering orifices. In a preferred embodiment, a fuel injector is provided. The fuel injector comprises a housing, a seat, a metering disc and a closure member. The housing has an inlet, an outlet and a longitudinal axis extending therethrough. The seat is disposed proximate the outlet. The seat includes a sealing surface, an orifice, and a first channel surface. The closure member is reciprocally located within the housing along the longitudinal axis between a first position wherein the closure member is displaced from the seat, allowing fuel flow past the closure member, and a second position wherein the closure member is biased against the seat, precluding fuel flow past the closure member. The metering disc includes a second channel surface confronting the first channel surface at an angle oblique to the longitudinal axis. The metering disc has a plurality of metering orifices extending through the disc along the longitudinal axis. The plurality of metering orifices is located about the longitudinal axis on a first virtual circle greater than a second virtual circle as defined by a projection of the sealing surface converging at a virtual apex projected on the metering disc. The controlled velocity channel is formed between the first and second channel surfaces. The controlled velocity channel has a first portion changing in cross-sectional area as the channel extends outwardly along the longitudinal axis to a location cincturing the plurality of metering orifices such that a fuel flow path exiting through each of the plurality of metering orifices forms a flow path oblique to the longitudinal axis.

In yet another embodiment, a method of controlling a spray angle of fuel flow through at least one metering orifice of a fuel injector is provided. The fuel injector has an inlet and an outlet and a passage extending along a longitudinal axis therethrough. The outlet has a seat and a metering disc. The seat has a seat orifice and a first channel surface extending obliquely to the longitudinal axis. The metering disc includes a second channel surface confronting the first channel surface so as to provide a frustoconical flow channel. The metering disc has a plurality of metering orifices extending therethrough along the longitudinal axis and located about the longitudinal axis. The method is achieved by locating the plurality of metering orifices on a first virtual circle outside a second virtual circle formed by a virtual extension of a sealing surface of the seat projecting on the metering disc such that each of the metering orifices extends along the longitudinal axis, the plurality of metering orifices oriented at respective arcuate distances with respect to each other on the second channel surface that is oriented at a dimpling angle with respect to the longitudinal axis; imparting the fuel flow with a radial velocity so that the fuel flow radially outward along the longitudinal axis between the first and second channel surfaces; and flowing fuel through each of the plurality of metering orifices having an orifice length and diameter such that a flow path of fuel with respect to the longitudinal axis is a function of at least one of the radial velocity, dimpling angle, orifice length, and orifice diameter.

BRIEF DESCRIPTIONS OF THE DRAWINGS

The accompanying drawings, which are incorporated herein and constitute part of this specification, illustrate an embodiment of the invention, and, together with the general description given above and the detailed description given below, serve to explain the features of the invention.

DETAILED DESCRIPTION OF THE PREFERRED EMBODIMENTS

Figure 1:
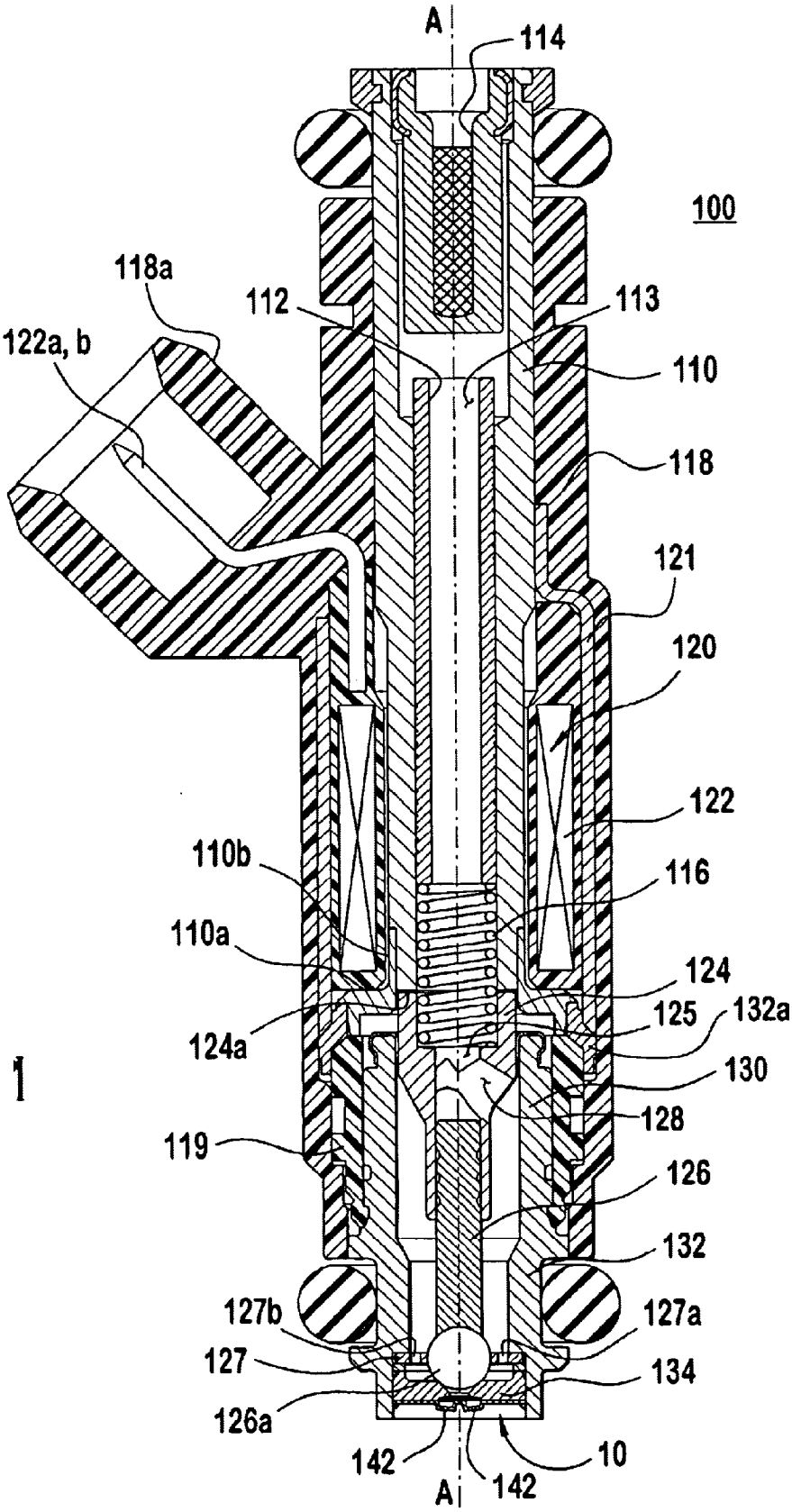
FIG. 1 illustrates a preferred embodiment of the fuel injector.

FIGS. 1–3 illustrate the preferred embodiments. In particular, a fuel injector 100 having a preferred embodiment of the metering disc 10 is illustrated in FIG. 1. The fuel injector 100 includes: a fuel inlet tube 110, an adjustment tube 112, a filter assembly 114, a coil assembly 120, a coil spring 116, an armature 124, a closure member 126, a non-magnetic shell 110*a*, a first overmold 118, a valve body 132, a valve body shell 132*a*, a second overmold 119, a coil assembly housing 121, a guide member 127 for the closure member 126, a seat 134, and a metering disc 10.

The guide member 127, the seat 134, and the metering disc 10 form a stack that is coupled at the outlet end of fuel injector 100 by a suitable coupling technique, such as, for example, crimping, welding, bonding or riveting. Armature 124 and the closure member 126 are joined together to form an armature/needle valve assembly. It should be noted that one skilled in the art could form the assembly from a single component. Coil assembly 120 includes a plastic bobbin on which an electromagnetic coil 122 is wound.

Respective terminations of coil 122 connect to respective terminals 122*a*, 122*b* that are shaped and, in cooperation with a surround 118*a* formed as an integral part of overmold 118, to form an electrical connector for connecting the fuel injector to an electronic control circuit (not shown) that operates the fuel injector.

Fuel inlet tube 110 can be ferromagnetic and includes a fuel inlet opening at the exposed upper end. Filter assembly 114 can be fitted proximate to the open upper end of adjustment tube 112 to filter any particulate material larger than a certain size from fuel entering through inlet opening before the fuel enters adjustment tube 112.

In the calibrated fuel injector, adjustment tube 112 has been positioned axially to an axial location within fuel inlet tube 110 that compresses preload spring 116 to a desired bias force that urges the armature/needle valve such that the rounded tip end of closure member 126 can be seated on seat 134 to close the central hole through the seat. Preferably, tubes 110 and 112 are crimped together to maintain their relative axial positioning after adjustment calibration has been performed.

After passing through adjustment tube 112, fuel enters a volume that is cooperatively defined by confronting ends of inlet tube 110 and armature 124 and that contains preload spring 116. Armature 124 includes a passageway 128 that communicates volume 125 with a passageway 113 in valve body 130, and guide member 127 contains fuel passage holes 127*a*, 127*b*. This allows fuel to flow from volume 125 through passageways 113, 128 to seat 134.

Non-ferromagnetic shell 110*a* can be telescopically fitted on and joined to the lower end of inlet tube 110, as by a hermetic laser weld. Shell 110*a* has a tubular neck that telescopes over a tubular neck at the lower end of fuel inlet tube 110. Shell 110*a* also has a shoulder that extends radially outwardly from neck. Valve body shell 132*a* can be ferromagnetic and can be joined in fluid-tight manner to non-ferromagnetic shell 110*a*, preferably also by a hermetic laser weld.

The upper end of valve body 130 fits closely inside the lower end of valve body shell 132*a* and these two parts are joined together in fluid-tight manner, preferably by laser welding. Armature 124 can be guided by the inside wall of valve body 130 for axial reciprocation. Further axial guidance of the armature/needle valve assembly can be provided by a central guide hole in member 127 through which closure member 126 passes.

Figure 2A:
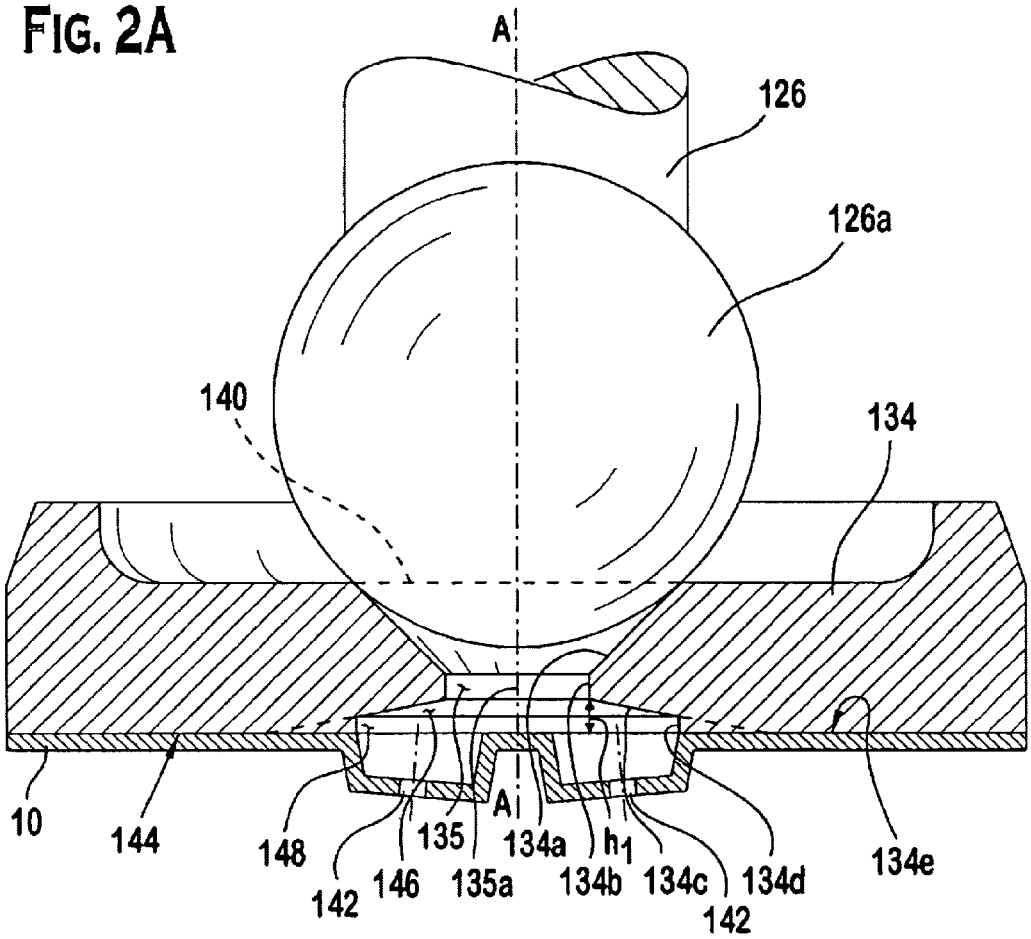
FIG. 2A illustrates a close-up cross-sectional view of an outlet end of the fuel injector of FIG. 1.

Referring to a close up illustration of the seat subassembly of the fuel injector in FIG. 2A which has a closure member 126, seat 134, and a metering disc 10. The closure member 126 includes a spherical surface shaped member 126*a* disposed at one end distal to the armature. The spherical member 126*a* engages the seat 134 on seat surface 134*a* so as to form a generally line contact seal between the two members. The seat surface 134*a* tapers radially downward and inward toward the seat orifice 135 such that the surface 134*a* is oblique to the longitudinal axis A—A. The words "inward" and "outward" refer to directions toward and away from, respectively, the longitudinal axis A—A. The seal can be defined as a sealing circle 140 formed by contiguous engagement of the spherical member 126*a* with the seat surface 134*a*, shown here in FIG. 2A. The seat 134 includes a seat orifice 135, which extends generally along the longitudinal axis A—A of the fuel injector 100 and is formed by a generally cylindrical wall 134*b*. Preferably, a center 135*a* of the seat orifice 135 is located generally on the longitudinal axis A—A.

Downstream of the circular wall 134*b*, the seat 134 tapers along a portion 134*c* towards the metering disc surface 134*e*.

Figure 2B:
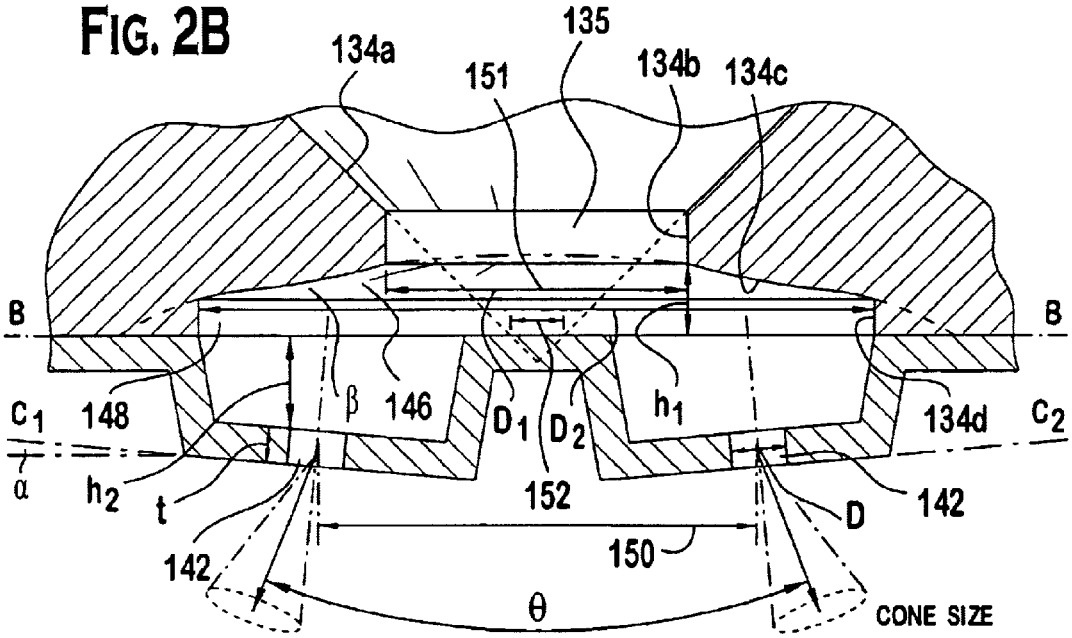
FIG. 2B illustrates a close-up cross-sectional view of an outlet end of the fuel injector of FIG. 1 according to yet another preferred embodiment.

The taper of the portion 134*c* preferably can be linear or curvilinear with respect to the longitudinal axis A—A, such as, for example, a curvilinear taper that forms an interior dome (FIG. 2B). In one preferred embodiment, the taper of the portion 134*c* is linearly tapered (FIG. 2A) downward and outward at a taper angle β away from the seat orifice 135 to a point radially past the metering orifices 142. At this point, the seat 134 extends along and is preferably parallel to the longitudinal axis so as to preferably form cylindrical wall surface 134*d*. The wall surface 134*d* extends downward and subsequently extends in a generally radial direction to form a bottom surface 134*e*, which is preferably perpendicular to the longitudinal axis A—A. In another preferred embodiment, the portion 134*c* can extend through to the surface 134*e* of the seat 134. Preferably, the taper angle β is approximately 10 degrees relative to a plane transverse to the longitudinal axis A—A.

The interior face 144 of the metering disc 10 proximate to the outer perimeter of the metering disc 10 engages the bottom surface 134*e* along a generally annular contact area. The seat orifice 135 is preferably located wholly within the perimeter, i.e., a "bolt circle" 150 defined by an imaginary line connecting a center of each of the metering orifices 142. That is, a virtual extension of the surface of the seat 135 generates a virtual orifice circle 151 preferably disposed within the bolt circle 150.

The cross-sectional virtual extensions of the taper of the seat surface 134*b* converge upon the metering disc so as to generate a virtual circle 152 (FIGS. 2A and 2B). Furthermore, the virtual extensions converge to an apex located within the cross-section of the metering disc 10. In one preferred embodiment, the virtual circle 152 of the seat surface 134*b* is located within the bolt circle 150 of the metering orifices. Stated another way, the bolt circle 150 is preferably entirely outside the virtual circle 152. Although the metering orifices 142 can be contiguous to the virtual circle 152, it is preferable that all of the metering orifices 142 are also outside the virtual circle 152.

A generally annular controlled velocity channel 146 is formed between the seat orifice 135 of the seat 134 and interior face 144 of the metering disc 10, illustrated here in FIG. 2A. Specifically, the channel 146 is initially formed between the intersection of the preferably cylindrical surface 134*b* and the preferably linearly tapered surface 134*c*, which channel terminates at the intersection of the preferably cylindrical surface 134*d* and the bottom surface 134*e*. In other words, the channel changes in cross-sectional area as the channel extends outwardly from the orifice of the seat to the plurality of metering orifices such that fuel flow is imparted with a radial velocity between the orifice and the plurality of metering orifices.

A physical representation of a particular relationship has been discovered that allows the controlled velocity channel 146 to provide a generally constant velocity to fluid flowing through the channel 146. In a preferred physical embodiment of this relationship, the channel 146 tapers outwardly from height $h_1$ at the seat orifice 135, as measured to referential datum B—B with corresponding radial distance $D_1$ to a height $h_2$, as measured to referential datum B—B, from a position along the longitudinal axis on the surface of the metering disc 10 that can be proximate, and preferably contiguous to the metering orifices 142 with corresponding radial distance $D_2$. Preferably, a product of the height $h_1$, distance $D_1$ and π is approximately equal to the product of the height $h_2$, distance $D_2$ and π (i.e. $D_1*h_1*\pi=D_2*h_2*\pi$ or $D_1*h_1=D_2*h_2$) formed by the seat 134 and the metering disc 10, which can be linear or curvilinear. The distance $h_2$ is believed to be related to the taper in that the greater the height $h_2$, the greater the taper angle β is required and the smaller the height $h_2$, the smaller the taper angle β is required. An annular volume 148, preferably cylindrical in shape is formed between the preferably linear wall surface 134*d* and the referential datum B—B. That is, as shown in FIG. 2A or 2B, a frustum is formed by the controlled velocity channel 146 downstream of the seat orifice 135, which frustum is contiguous to preferably a right-angled cylinder formed by the annular volume 148.

By providing a generally constant velocity of fuel flowing through the controlled velocity channel 146, it is believed that a sensitivity of the position of the metering orifices 142 relative to the seat orifice 135 in spray targeting and spray distribution is minimized. That is to say, due to manufacturing tolerances, an acceptable level concentricity of the array of metering orifices 142 relative to the seat orifice 135 may be difficult to achieve. As such, features of the preferred embodiment are believed to provide a metering disc for a fuel injector that is believed to be less sensitive to concentricity variations between the array of metering orifices 142 on the bolt circle 150 and the seat orifice 135. It is also noted that those skilled in the art will recognize that from the particular relationship, the velocity can decrease, increase or both increase/decrease at any point throughout the length of the channel 146, depending on the configuration of the channel, including varying $D_1$, $h_1$, $D_2$ or $h_2$ of the controlled velocity channel 146, such that the product of $D_1$ and $h_1$ can be less than or greater than the product of $D_2$ and $h_2$.

In another preferred embodiment, the cylinder of the annular volume 148 is not used, and instead, only a frustum forming part of the controlled velocity channel 146 is formed. That is, the channel surface 134*c* extends all the way to the surface 134*e* contiguous to the metering disc 10, which is referenced in FIGS. 2A and 2B as dashed lines.

By imparting a different radial velocity to fuel flowing through the seat orifice 135, it has been discovered that the spray separation angle of fuel spray exiting the metering orifices 142 can be changed as a generally linear function of the radial velocity—i.e., the "linear separation angle effect." The radial velocity can be changed preferably by changing the configuration of the seat subassembly (including $D_1$, $h_1$, $D_2$ or $h_2$ of the controlled velocity channel 146), changing the flow rate of the fuel injector, or by a combination of both.

Furthermore, it has also been discovered that spray separation targeting can also be adjusted by varying a ratio of the through-length (or orifice length) "t" of each metering orifice to the diameter "D" of each orifice. In particular, the spray separation angle θ is linearly and inversely related to the aspect ratio t/D. The spray separation angle θ and cone size of the fuel spray are related to the aspect ratio t/D. As the aspect ratio increases or decreases, the separation angle θ and cone size increase or decrease, at different rates, correspondingly. Where the distance D is held constant, the larger the thickness "t", the smaller the separation angle θ and cone size. Conversely, where the thickness "t" is smaller, the separation angle θ and cone size are larger. Hence, where a small cone size is desired but with a large spray separation angle, it is believed that spray separation can be accomplished by configuring the velocity channel 146 and space 148 while cone size and to a lesser extent, the separation angle θ, can be accomplished by configuring the t/D ratio of the metering disc 10. It should be reiterated that the ratio t/D not only affects the spray separation angle, it also affects a size of the spray cone emanating from the metering orifice in a generally linear and inverse manner to the ratio t/D—i.e., the "linear and inverse separation effect."

Although the through-length "t" (i.e., the length of the metering orifice along the longitudinal axis A—A) is shown in FIG. 2B as being substantially the same as that of the thickness of the metering disc 10, it is noted that the thickness of the metering disc can be different from the through-length t of each of the metering orifices 142. As used herein, the term "cone size" denotes the circumference or area of the base of a fuel spray pattern defining a conic fuel spray pattern as measured at predetermined distance from the metering disc of the fuel injector 100.

Figure 3A:
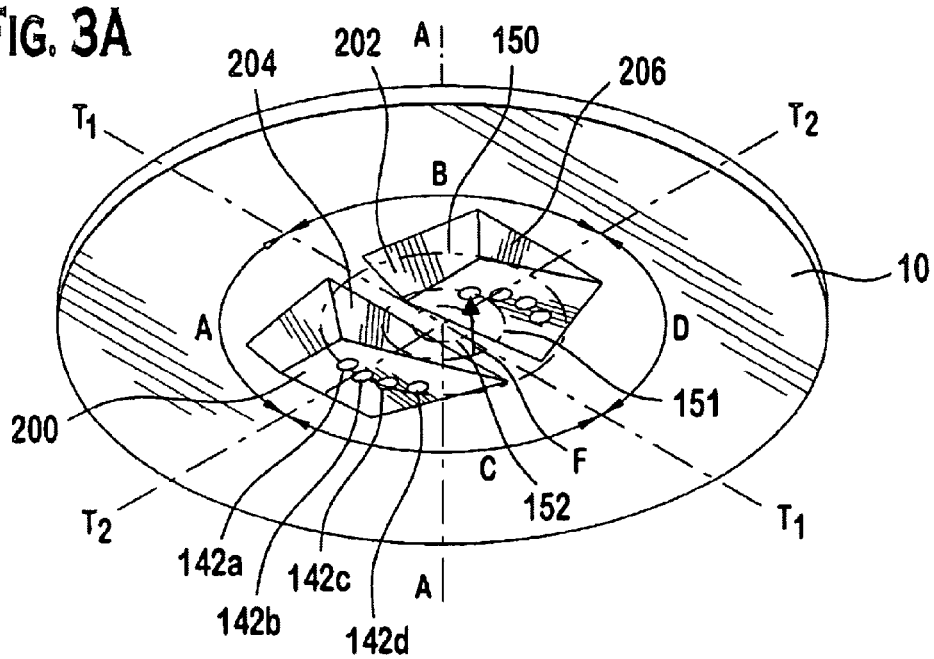
FIG. 3A illustrates a perspective view of an orifice disc in FIG. 2*a* as seen from a downstream end of the disc according to a preferred embodiment.
Figure 3B:
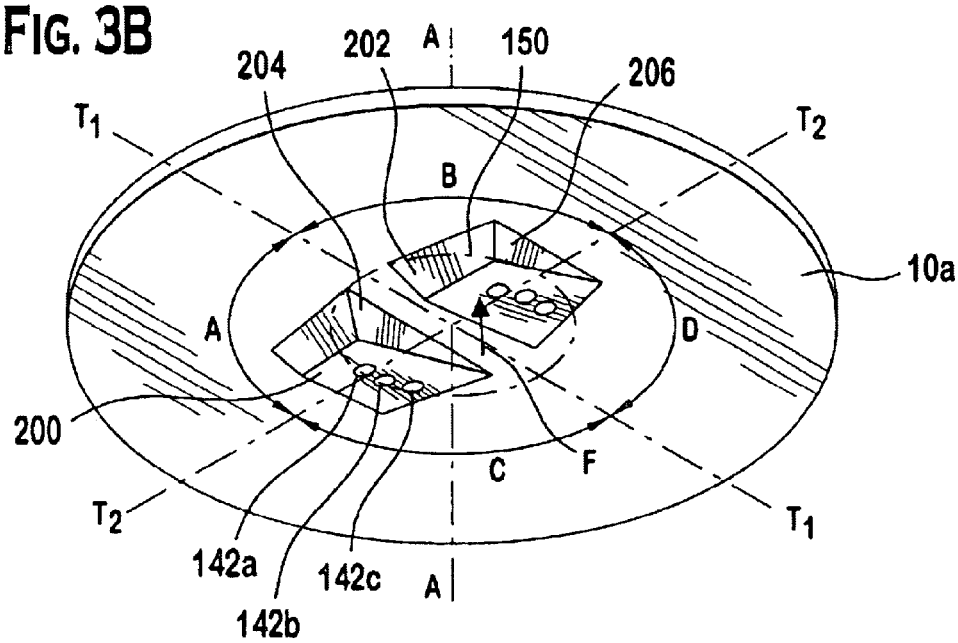
FIG. 3B illustrates a perspective view of a modified orifice disc of FIG. 2*b* as seen from a downstream end of the disc according to another preferred embodiment.

The metering disc 10 has a plurality of metering orifices 142, each metering orifice 142 having a center located on an imaginary "bolt circle" 150 shown here in FIG. 3A prior to a deformation or dimpling of the metering disc 10. For clarity, each metering orifice is labeled as 142*a*, 142*b*, 142*c*, and 142*d* . . . and so on. Although the metering orifices 142 are preferably circular openings, other orifice configurations, such as, for examples, square, rectangular, arcuate or slots can also be used. The metering orifices 142 are arrayed in a preferably circular configuration, which configuration, in one preferred embodiment, can be generally concentric with the virtual circle 152. A seat orifice virtual circle 151 is formed by a virtual projection of the orifice 135 onto the metering disc such that the seat orifice virtual circle 151 is outside of the virtual circle 152 and preferably generally concentric to both the first and second virtual or bolt circle 150 that, preferably, extends orthogonal to the longitudinal axis A—A even though the metering orifices 142 may be formed on a non-planar surface. Extending from the longitudinal axis A—A are two perpendicular axes $T_1$—$T_1$ *and* $T_2$—$T_2$ that along with the bolt circle 150 divide the bolt circle into four contiguous quadrants A, B, C and D. In a preferred embodiment, the metering orifices on each quadrant are diametrically disposed with respect to corresponding metering orifices on a distal quadrant. The preferred configuration of the metering orifices 142 and the channel allows a flow path "F" of fuel extending radially from the orifice 135 of the seat in any one radial direction away from the longitudinal axis towards the metering disc passes to one metering orifice or orifice.

In addition to spray targeting with adjustment of the radial velocity (i.e., the "linear separation effect") and cone size determination by the controlled velocity channel and the ratio t/D (i.e., "the linear and inverse separation effect"), respectively, the spray separation angle can be increased even more than the separation angle θ generated as a function of the radial velocity through the channel 146 or the separation θ as a function of the ratio t/D. The increase in separation angle θ can be accomplished by dimpling the surface on which the metering orifices 142 is located so that a generally planar surface on which the metering surface can be oriented on a plane oblique to the referential datum axis B—B. As used herein, the term "dimpling" denotes that a generally material can be deformed by stamping or deep drawing to form a non-planar surface that can be oriented along at least one plane oblique to the referential datum axis B—B. That is to say, a surface on which at least one metering orifice 142 is disposed thereon can be oriented along a plane C1 and at least another metering orifice 142 can be disposed on a surface oriented along a plane C2 oblique to axis B—B. In a preferred embodiment, the planes C1 and C2 are generally symmetrical about the longitudinal axis A—A.

Depending on the configuration of the seat and metering orifice disc, a pressure drop of the fuel flowing between the seat and the metering disc can be greater or less than desired. In some configurations of the fuel injector 100, the pressure drop imparted to the fuel flow as the fuel flow diverges from the seat orifice 135 towards the metering disc 10 through the channel 146 can be higher than is desirable, which can lead to, in some configurations, a restriction in fuel flowing through the metering orifices 142. In such a configuration, the channel 146 can be configured to permit a lower pressure drop of fuel flowing through the channel 146 by modifying the channel 146 with a change in the taper angle β, which can lead to a lower radial velocity of the fuel flow F than desired. This leads to a smaller separation angle θ than that required for a particular configuration of the fuel injector 100.

However, in the above example, the separation angle θ can be increased so as to satisfy the separation angle requirement by reducing the thickness "t" of the orifice disc 10 so that, holding the metering orifice diameter "D" constant, the ratio t/D decreases so as to increase the separation angle θ. However, there is a limit as to how thin a metering disc can be reduced before the disc 10 is unsuitable for use in a fuel injector in this technique. In order to achieve a separation angle greater than the separation angle possible with manipulation of the radial velocity channel 146 or the ratio t/D, the surface of the metering disc 10 can be dimpled to a desired angle, i.e., a dimpling angle α, as measured relative to the generally horizontal surface of the metering disc or referential datum B—B. And an actual separation angle ϕ can be, generally, the sum of the dimpling angle α and the angle θ formed by either manipulation of the channel 146 or the aspect ratio t/D of the metering disc 10. Preferably, the dimpling angle α is approximately 10 degrees. And as used herein, the term "approximately" encompasses the stated value plus or minus 25 percent (±25%).

Thus, it has been discovered that manipulation of at least one of either the taper of the flow channel 146 or the ratio t/D allows a metering orifice extending parallel to the longitudinal axis A—A (i.e., a straight orifice) to emulate an oblique metering orifice (i.e., an orifice extending oblique to the longitudinal axis A—A) that provides for a desired spray separation angle θ. Furthermore, it has also been discovered that by deforming the surface of the metering disc on which the straight metering orifice 142 is formed, further increases in the separation angle θ can be achieved while satisfying other parametric requirements such as, for example, a required pressure drop, required thickness of metering disc 10, or required metering orifice opening size.

Figure 3C:
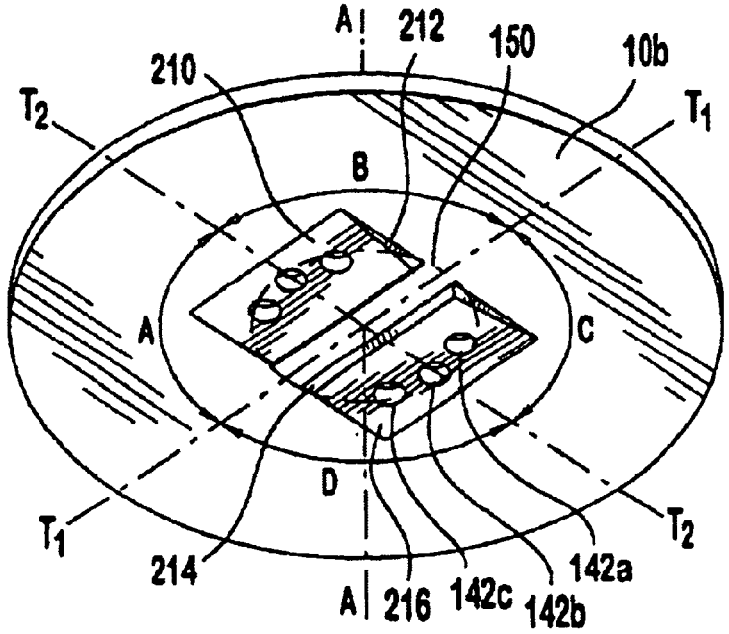
FIG. 3C illustrates a perspective view of a split spray stream orifice disc as seen from a downstream end of the disc according to yet another preferred embodiment.
Figure 3D:
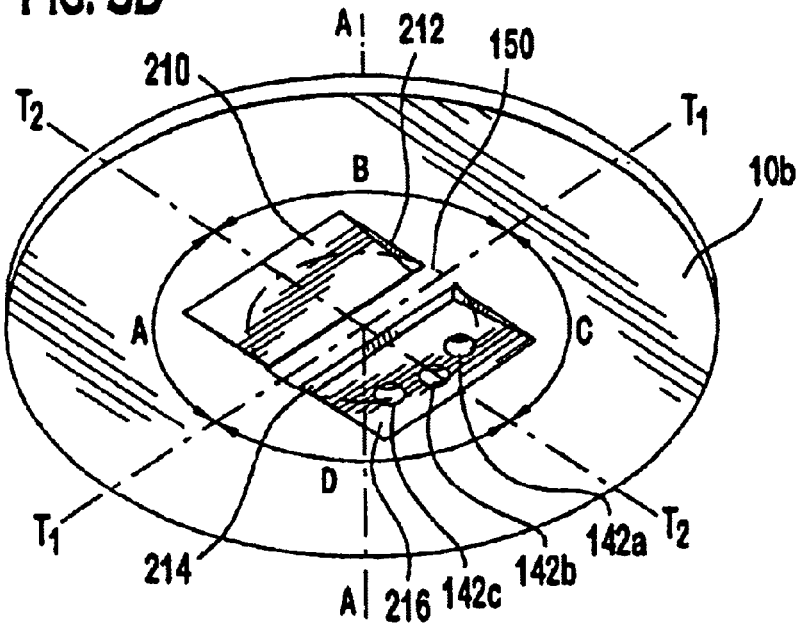
FIG. 3D illustrates a perspective of a split spray stream orifice disc as seen from a downstream end of the disc that orientates a fuel spray towards an arcuate sector according to yet another preferred embodiment.

Additionally, it has been discovered that a spatial orientation of the non-angled orifice openings 142 can also be used to shape the pattern of the fuel spray by changing the arcuate distance "L" between the nearest adjacent surfaces of any two neighboring metering orifices 142 along a bolt circle 150 (e.g., FIGS. 3C and 3D). Thus, a relatively close arcuate distances L of the metering orifice relative to each other form a narrow cone pattern and spacing of the arcuate distance L at a greater arcuate distances form a relatively wider cone pattern at a relatively smaller spray separation angle.

As shown in FIG. 3A, the metering orifices 142 are preferably located in four arcuate sectors A, B, C, and D such that fuel sprays emanating from the orifices form a fuel spray pattern that generally diverges away from the transverse axis $T_1$—$T_1$ and is targeted towards sectors D and C due to the dimpled surfaces 200 forming a generally oblique surface relative to the longitudinal axis A—A. The dimpled surface 200 generally includes at least three wall surfaces 202, 204 and 206 oblique to the longitudinal axis A—A. The number of metering orifices on a dimpled surface 202 of the metering disc 10 can also affect the cone size such that the lower the number of metering orifices, such as, for example, in another preferred embodiment of the metering disc 10*a*, shown here in FIG. 3B, the smaller the spray cone size.

The fuel spray can also be configured so as to form a split-spray pattern that generally diverges away from transverse axis $T_1$—$T_1$ and is generally targeted to two diametrical sectors as shown in FIG. 3C for metering disc 10*b*. In FIG. 3C, the surface 204 on which the metering orifices are located is dimpled in a preferred embodiment that targets two diametrical sectors where each targeted sector is a combination of sectors A, B and sectors C, D, respectively.

The fuel spray can also be configured in yet another preferred embodiment in FIG. 3D so as to form a split-spray pattern that generally diverges away from transverse axis $T_1$—$T_1$ and generally targeted to two adjacent arcuate sectors B and C such that the fuel spray pattern can be considered to be a split-spray pattern with bending or tipping of the spray due to the configuration of the dimpled surface 210 having wall surfaces 212, 214, and 216. In the preferred embodiment shown exemplarily in FIG. 3D, the metering orifices 142 are located within two adjacent arcuate sectors A and D such that when the surface of the metering disc 10*c* is deformed to form a dimpled surface 210 having oblique wall surfaces 222, 224, 226, 228, 230, the split spray pattern is bent or tipped toward the two adjacent arcuate sectors A and D.

The adjustment of arcuate distances L can also be used in conjunction with the techniques previously described so as to tailor the spray geometry (narrower spray pattern with greater spray angle to wider spray pattern but at a smaller spray angle by) of a fuel injector to a specific engine design while using non-angled metering orifices (i.e. orifices having an axis generally parallel to the longitudinal axis A—A) that can be adjusted by dimpling the surface of the metering disc on which the non-angled metering orifices are located on.

In operation, the fuel injector 100 is initially at the non-injecting position shown in FIG. 1. In this position, a working gap exists between the annular end face 110*b* of fuel inlet tube 110 and the confronting annular end face 124*a* of armature 124. Coil housing 121 and tube 12 are in contact at 74 and constitute a stator structure that is associated with coil assembly 120. Non-ferromagnetic shell 110*a* assures that when electromagnetic coil 122 is energized, the magnetic flux will follow a path that includes armature 124. Starting at the lower axial end of housing 34, where it is joined with valve body shell 132*a* by a hermetic laser weld, the magnetic circuit extends through valve body shell 132*a*, valve body 130 and eyelet to armature 124, and from armature 124 across working gap 72 to inlet tube 110, and back to housing 121.

When electromagnetic coil 122 is energized, the spring force on armature 124 can be overcome and the armature is attracted toward inlet tube 110 reducing working gap 72. This unseats closure member 126 from seat 134 open the fuel injector so that pressurized fuel in the valve body 132 flows through the seat orifice and through orifices formed on the metering disc 10, 10*a*, 10*b* or 10*c*. It should be noted here that the actuator may be mounted such that a portion of the actuator can disposed in the fuel injector and a portion can be disposed outside the fuel injector. When the coil ceases to be energized, preload spring 116 pushes the armature/needle valve closed on seat 134.

As described, the preferred embodiments, including the techniques or method of targeting, are not limited to the fuel injector described but can be used in conjunction with other fuel injectors such as, for example, the fuel injector sets forth in U.S. Pat. No. 5,494,225 issued on Feb. 27, 1996, or the modular fuel injectors set forth in Published U.S. Patent Application No. 2002/0047054 A1, published on Apr. 25, 2002, which is pending, and wherein both of these documents are hereby incorporated by reference in their entireties.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A fuel injector comprising:

a housing having an inlet, an outlet, and a longitudinal axis extending therethrough;

a seat disposed proximate the outlet, the seat having a sealing surface surrounding a seat orifice being disposed along the longitudinal axis between the sealing surface and a first channel surface;

a closure member reciprocally located within the housing along the longitudinal axis between a first position displaced from the sealing surface to permit fuel flow through the seat orifice and a second position of the closure member contiguous to the sealing surface to occlude fuel flow;

a metering disc including a second channel surface confronting the first channel surface at an angle oblique to the longitudinal axis, the metering disc having a plurality of metering orifices extending through the disc along the longitudinal axis, the plurality of metering orifices being located about the longitudinal axis on a first virtual circle greater than a second virtual circle defined by a projection of the sealing surface converging at a virtual apex projected on the metering disc; and a controlled velocity channel formed between the first and second channel surfaces, the controlled velocity channel having a first portion changing in cross-sectional area as the channel extends outwardly along the longitudinal axis to a location cincturing the plurality of metering orifices such that fuel flow exiting through each of the plurality of metering orifices forms a flow path oblique to the longitudinal axis.

2. The fuel injector of claim 1, wherein the controlled velocity channel extends between a first end and a second end, the first end disposed at a first radius from the longitudinal axis with the first and second channel surfaces spaced apart along the longitudinal axis at a first distance, the second end disposed at a second radius proximate the plurality of metering orifices with respect to the longitudinal axis with the first and second channel surfaces spaced apart along the longitudinal axis at a second distance such that a product of two times the trigonometric constant pi ($\pi$) times the first radius and the first distance is equal to a product of two times the trigonometric constant pi ($\pi$) of the second radius and the second distance.

3. The fuel injector of claim 2, wherein the plurality of metering orifices includes at least two metering orifices diametrically disposed on the first virtual circle.

4. The fuel injector of claim 3, wherein the plurality of metering orifices includes at least two metering orifices disposed at a first arcuate distance relative to each other on the first virtual circle.

5. The fuel injector of claim 4, wherein the plurality of metering orifices includes at least three metering orifices spaced at different arcuate distances on the first virtual circle.

6. The fuel injector of claim 1, wherein the plurality of metering orifices includes at least two metering orifices, each metering orifice having a through-length and an orifice diameter and configured such that an increase in a ratio of the through-length relative to the orifice diameter results in a decrease in the spray angle relative to the longitudinal axis.

7. The fuel injector of claim 1, wherein the plurality of metering orifices includes at least two metering orifices, each metering orifice having a through-length and an orifice diameter and configured such that an increase in a ratio of the through-length relative to the orifice diameter results in a decrease in an included angle of a spray cone produced by each metering orifice.

8. The fuel injector of claim 5, wherein second channel surface comprises a first generally planar surface portion cincturing second and third surface portions, the second and third surface portions projecting from the plane contiguous to the first generally planar surface portion.

9. The fuel injector of claim 8, wherein the second and third surface portions comprise at least two planar surfaces.

10. The fuel injector of claim 9, wherein the third surface portion intersects the longitudinal axis.

11. The fuel injector of claim 10, wherein the plurality of metering orifices is disposed on at least one of the two at least two planar surfaces of the second surface portion.

12. The fuel injector of claim 11, wherein the first channel surface includes at least a portion extending at a taper angle with respect to the longitudinal axis.

13. The fuel injector of claim 12, wherein the taper angle comprises a taper angle of approximately ten degrees with respect to a plane transverse to the longitudinal axis.

14. The fuel injector of claim 12, wherein the first channel surface comprises a portion curved with respect to the at least a portion of the first channel surface.

15. A method of controlling a spray angle of fuel flow through at least one metering orifice of a fuel injector having an inlet, outlet, and passage extending along a longitudinal axis extending therethrough, the outlet having a seat and a metering disc, the seat has a seat orifice and a first channel surface extending oblique to the longitudinal axis, the metering disc having a second channel surface confronting the first channel surface so as to provide a flow channel, the metering disc having a plurality of metering orifices extending through the metering disc along the longitudinal axis, the method comprising:

locating the plurality of metering orifices on a first virtual circle outside a second virtual circle formed by a virtual extension of a sealing surface of the seat projecting on the metering disc such that each of the metering orifices extends along the longitudinal axis, the plurality of metering orifices oriented at respective arcuate distances with respect to each other on a first portion of the second channel surface that is oriented at an oblique dimpling angle with respect to the longitudinal axis, the second channel surface including second and third portions oblique to the longitudinal axis;

imparting the fuel flow with a radial velocity so that the fuel flows radially outward along the longitudinal axis between the first and second channel surfaces; and flowing fuel through each of the plurality of metering orifices having an orifice length and diameter such that a flow path of fuel with respect to the longitudinal axis is a function of at least one of the radial velocity, dimpling angle, orifice length, and orifice diameter.

16. The method of claim 15, wherein locating further comprises adjusting the flow path of fuel away from the outlet at a greater included angle with respect to the longitudinal axis by reducing the orifice length of each metering orifice with the dimpling angle, radial velocity, and orifice diameter unchanged.

17. The method of claim 15, wherein locating further comprises adjusting the flow path of fuel away from the outlet at a smaller included angle with respect to the longitudinal axis by increasing the orifice length of each metering orifice with the dimpling angle, radial velocity, and orifice diameter unchanged.

18. The method of claim 15, wherein the locating further comprises adjusting the dimpling angle with the radial velocity, orifice length, orifice diameter unchanged such that an increased dimpling angle results in a greater included angle between the flow path of fuel from the outlet with respect to the longitudinal axis.

19. The method of claim 18, wherein the locating comprises adjusting the dimpling angle with respect to a first axis transverse relative to the longitudinal axis and with respect to a second transverse axis orthogonal to the longitudinal and first axes.

20. The method of claim 15, wherein the locating further comprises adjusting a cone size of the fuel flow emanating from the outlet by locating each of the metering orifices at different arcuate distances on the first virtual circle.

* * * * *